United States Patent [19]

Knight

[11] Patent Number: 4,603,725

[45] Date of Patent: Aug. 5, 1986

[54] HEADRAIL FOR A WINDOW BLIND

[76] Inventor: Douglas W. Knight, 1376 Liberty St., Winnipeg, Mantioba, Canada, R3S 1A6

[21] Appl. No.: 643,954

[22] Filed: Aug. 24, 1984

[51] Int. Cl.[4] ..... A47G 5/02

[52] U.S. Cl. ..... 160/243; 160/133

[58] Field of Search ..... 160/243, 133, 84 R, 160/244, 245, 19, 38, 168 R

[56] References Cited

U.S. PATENT DOCUMENTS

| | | | |
|---|---|---|---|
| 2,188,134 | 1/1940 | Hough | 160/133 |
| 2,299,060 | 10/1942 | Sarran et al. | 160/133 |
| 2,808,222 | 10/1957 | Wassying et al. | 160/19 X |
| 3,246,685 | 4/1966 | Anderson et al. | 160/243 X |
| 4,520,608 | 6/1985 | Baus | 160/38 X |

FOREIGN PATENT DOCUMENTS

| | | | |
|---|---|---|---|
| 1270759 | 6/1968 | Fed. Rep. of Germany | 160/84 R |
| 1557413 | 8/1969 | France | 160/168 |
| 2227842 | 11/1974 | France | 160/38 |
| 560833 | 4/1975 | Switzerland | 160/243 |

*Primary Examiner*—Ramon S. Britts
*Assistant Examiner*—David M. Purol
*Attorney, Agent, or Firm*—Stanley G. Ade; Adrian D. Battison

[57] ABSTRACT

A headrail for a window blind is formed as an integral extrusion comprising a front valance and including rearwardly of the valance a first upward facing channel for receiving the pulley mechanism and a second downwardly facing channel for clamping the blind edge. A wall between the two channels extends upwardly beyond the channels and then rearwardly and downwardly to provide a flange whereby the headrail can be supported on a suitable hook member.

4 Claims, 3 Drawing Figures

HEADRAIL FOR A WINDOW BLIND

BACKGROUND OF THE INVENTION

This invention relates to a headrail for a window blind.

Window blinds have been manufactured for many years particularly of the type where an upper edge of the blind formed from a flexible fabric is clamped at a headrail above the window and the blind is rolled or folded upwardly from the bottom by a pull string which is mounted in a pulley at the headrail. Such blinds are of the roll-up type in which a roll is formed at the bottom edge of the blind with the roll being moved upwardly of the blind by the pull cord until it reaches a required position either at the headrail or at an intermediate position across the window. A second type known as the Roman type involves the pull cord being threaded through the blind so that it folds in a series of layers as the pull cord is drawn upwardly by the pulley device in the headrail. It will be appreciated that both of these types can use the same type of headrail.

For many years blinds of these type have been manufactured using a valance formed by a strip of the blind fabric which hangs forwardly over the headrail and this hides the working mechanisms at the top of the blind. These arrangements are however unsatisfactory in that they are complicated and expensive to manufacture thus increasing the price of what otherwise could be an economic and effective technique for covering windows providing a neat and modern appearance relative to conventional drapes. Other more recent techniques have provided a plastic front facing or valance of a rigid plastics material which covers the working arrangements without the necessity for a separate fabric portion to provide a hanging covering. However, arrangements of this type have been difficult to assemble and manufacture, this again increasing the price of the finished product to the public.

SUMMARY OF THE INVENTION

It is one object of the present invention, therefore, to provide an improved headrail for a window blind which incorporates a valance or facing plate so as to present forwardly an acceptable appearance without the necessity for an over-hanging fabric portion or other separate valance.

According to the invention, therefore, there is provided a headrail for a window blind in the form of an integral extruded section providing a front valance, a channel defined by side walls and a bottom web and arranged rearwardly of the valance for receiving a cord pulley device for raising and lower the blind, a channel portion rearwardly of the pulley channel defining a slot for receiving and clamping an edge of the blind and means for receiving a support member whereby the headrail can be attached to a suitable surface for supporting the blind depending downwardly therefrom rearwardly of the valance and the pulley channel.

According to a second aspect of the invention there is provided a combination of parts for assembling a headrail for a window blind comprising an integral extruded section providing a front valance, a channel defined by side walls and a bottom web and arranged rearwardly of the valance for receiving a cord pulley device for raising and lower the blind, a channel portion rearwardly of the pulley channel defining a slot for receiving and clamping an edge of the blind and means for receiving a support member whereby the headrail can be attached to a suitable surface for supporting the blind depending downwardly therefrom rearwardly of the valance and the pulley channel, a cord pulley device mounted in the pulley channel at an opening in the bottom web thereof and means defining a hole in the bottom web adjacent to the pulley device through which the cord can pass and a plurality of hook members.

It is one advantage of the invention therefore that it provides in a single headrail a valance or facing plate which provides a pleasing front appearance together with a support arrangement for the required pull cord pulley, a clamping device for the upper edge of the window blind and a support member by which the headrail can be attached to a ceiling or wall. The assembly of the headrail to the necessary pulleys and blind is therefore very simple and in addition the headrail can be simply attached as an integral unitary item to the ceiling or wall.

In a preferred arrangement the pulleys are supported in an upwardly facing channel immediately rearward of the valance and the blind is clamped by a downwardly facing channel immediately rearward of the pulley channel. In between the pulley channel and the clamping channel is provided the attachment member for attaching the integral headrail to the ceiling or wall. Preferably this can comprise a downwardly inclined and rearwardly projecting surface which can engage an upwardly and forwardly projecting hook member.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
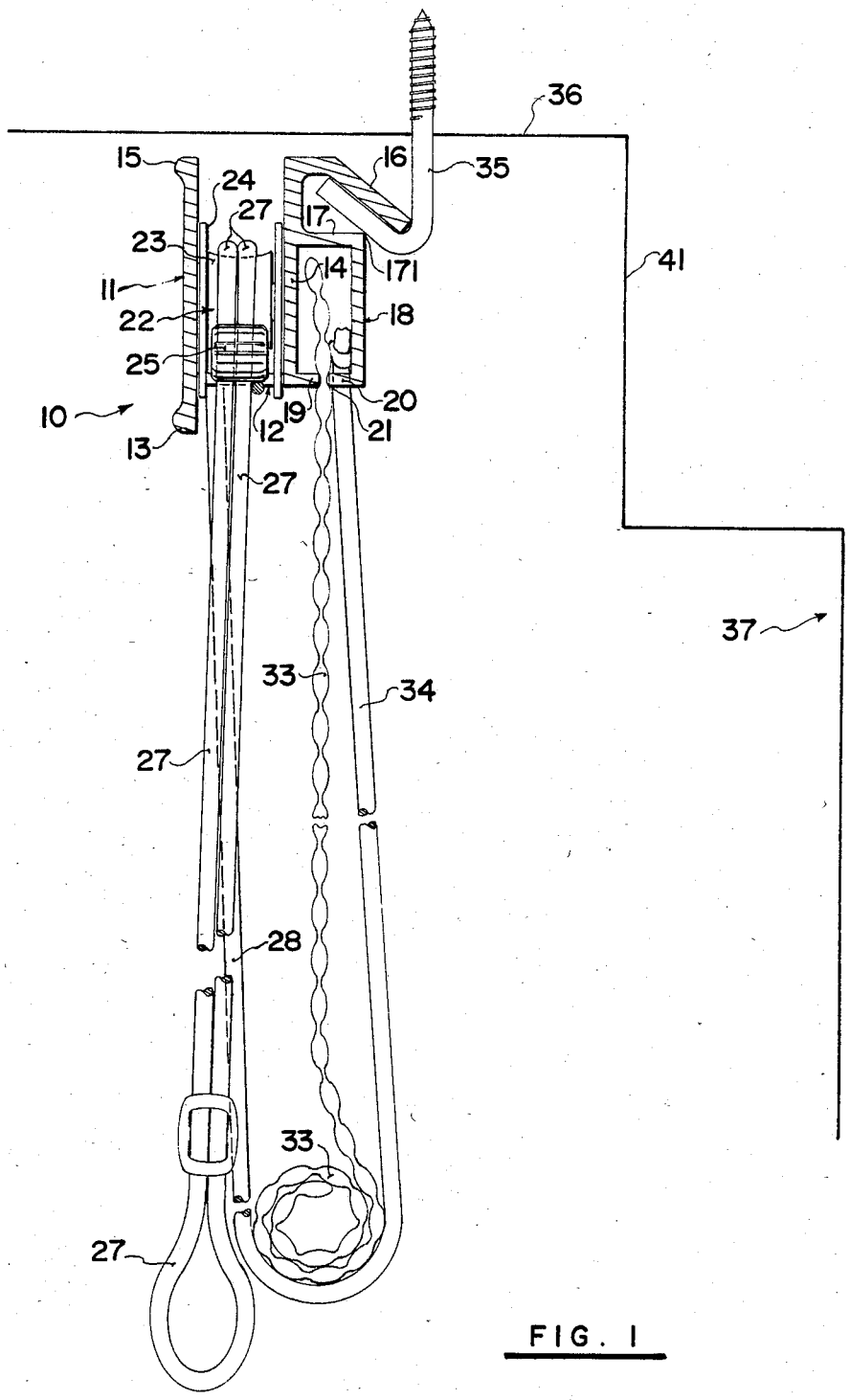
FIG. 1 is an end elevational view of a headrail and blind combination showing the headrail attached to the ceiling.

The headrail is generally indicated at 10 and comprises and extrusion from plastics material having a cross-section as shown in FIG. 1. Specifically the cross-section comprises a vertical front face or valance 11 in the form of a wall having a rounded upper and lower edge so as to provide a front surface of slightly concave shape to provide a pleasing appearance. The wall 11 extends over a height greater then the remainder of the headrail so as to provide a complete front face for the headrail which effectively hides the working parts behind the headrail.

Integral with and inter-connected to the front wall 11 is a horizontal second wall 12 which extends rearwardly therefrom at a position slightly above the bottom curved edge indicated at 13 of the front wall 11. The end of the second wall 12 remote from the front wall 11 is integrally connected to a second vertical or upstanding wall 14 parallel to the front wall 11 so that the walls 11, 12 and 14 define a U-channel. The height of the wall 14 is such that it terminates at a level substantially equal to the top edge indicated at 15 of the valance 11.

The top edge of the wall 14 turns downwardly into a downwardly and rearwardly inclined flange 16. At a position intermediate the height of the wall 14, a rearwardly extending horizontal wall 17 is integrally connected. The wall 17 is in turn connected to a vertical wall 18 parallel to the wall 14 and defining therewith an inverted U-channel. A projecting edge 19 is connected to the bottom edge of the wall 14 so as to project toward a second projecting edge 20 from the bottom of the wall 18 so that the open face of the inverted U-channel is confined to a narrow slot indicated at 21.

In practice it will be appreciated that the extrusion forming the headrail is formed continuously and cut to suitable lengths for supply. The lengths can then be cut to individual length for providing a headrail for a window blind and then assemble as described hereinafter. Suitable materials will of course be apparent to one skilled in the art.

When cut to length the headrail is completed by the introduction of a pulley and latch device which can be of a conventional arrangement and is generally indicated at 22. The device 22 comprises a pulley wheel 23 mounted in a frame 24 and a latch wheel 25 which can move in the frame 24 to lock the pull cord in a desired position. In order to assemble the device 22 into the headrail, a hole or opening 26 is cut in the wall 12 that is at the bottom of the U-channel and the frame 24 latched into place by suitable tabs. The pull cord is then threaded into position so that a manually drawable portion of the pull cord indicated at 27 leaves from the pulley wheel 23 downwardly for manual actuation. A second portion of the pull cord indicated at 28 extends from the pulley through a hole 29 cut in the lower wall 12 adjacent the opening 26. A further portion of pull cord extends along the channel in the headrail and indicated at 30 so as to pass through a further hole 31 and again extend downwardly parallel to the portion 28 as indicated at 32.

An upper edge of a blind indicated at 33 is clamped into the slot 21 by flexing the wall 18 away from the wall 14 so as to open the slot 21 following which an edge of the blind can be inserted preferably by sliding from one end so that the edge is clamped within the channel for support from the headrail. In addition a return portion of the cord 28 indicated at 34 can be clamped into the channel and particularly the slot 21 so that the cord 28, 34 extended downwardly and around the blind back to the pulley mechanism 22.

As shown in FIG. 1 a hook of a simple angle type indicated at 35 can be screwed into the ceiling indicated at 36 so that an arm of the hook extends upwardly and forwardly for engaging the flange 16. Thus the flange 16 can be supported on a number of the hooks 35 and in practice the hooks can be screwed into the ceiling firstly and then the headrail looped over the hooks by engaging the end of the flange 16 over the hook and then twisting the headrail in a clockwise direction as illustrated in FIG. 1 to assume the position illustrated in FIG. 1 where the hook member 35 engages between the flange 16 and an upper corner 171 between the walls 17 and 18. In this position the blind can hang downwardly in front of the window indicated schematically at 37. When it is desired to draw up the blind 33, the cord 27 can be pulled thus drawing up the portion 28 onto the pulley and acting to roll the blind in the loop formed between the portion 28 and the portion 34. The portion indicated at 32 in FIG. 2 also acts in a similar manner to retain the bottom edge of the blind horizontal while it is rolling upwardly to collect the blind and draw it up either completely to the headrail or to an intermediate position over the window.

Figure 2:
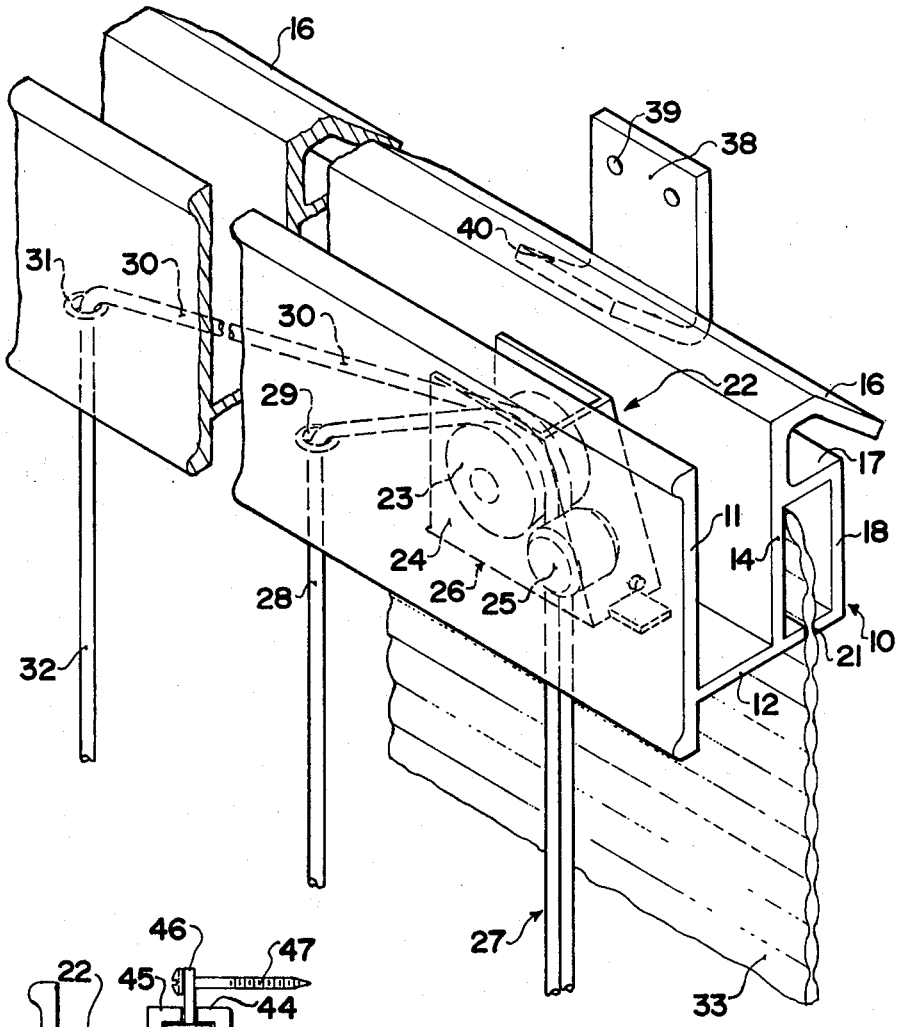
FIG. 2 is an isometric view on an enlarged scale of the headrail of FIG. 1 using an alternative type of supporting hook.

As indicated in FIG. 2, the valance 11 provides a front surface which is effectively the only surface visible of the headrail and provides a pleasing appearance. It will be appreciated that the valance can be shaped in any suitable manner to provide the front face of a pleasing shape and the slightly concave shape illustrated is merely one example.

In FIG. 2 also is illustrated a plate type hook 38 which includes two flat plates 39 and 40, the former for screwing to a wall and the latter inclined upwardly so as to lie parallel to and engage the flange 16. In an alternative arrangement (not shown) a hook similar to the hook 35 of FIG. 1 can include a right angle bend so that it can be screwed into the wall indicated at 41 at so provide the upwardly inclined hook portion for engaging the flange 16.

Figure 3:
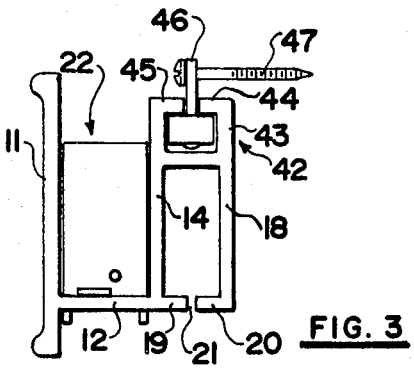
FIG. 3 is an end elevational view similar to FIG. 1 of a second embodiment of headrail incorporating a modified support system for attachment to the wall.

Turning now to FIG. 3, a modified arrangement is shown of substantially the same construction as the embodiment of FIG. 1 except that the flange 16 is replaced by a channel generally indicated at 42 defined by the upper portion of the wall 14 and an additional wall 43 parallel thereto so as to define an upwardly facing channel including closing edges 44, 45 thus defining a slot similar to and directly above the slot 21. The slot can then receive a T-shaped support member 46 which can be suitably attached to the wall by screws 47. It will be appreciated therefore that the support for the headrail is provided directly above the inverted clamping channel and effectively provides support at a mid-point of the headrail in the wall 14 so that it is supported and maintains a proper orientation with the valance 11 substantially vertical.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A headrail for a window bind comprising an integral extruded section defining a first upright wall providing a front valance, a second horizontal wall connected to said first wall adjacent a lower edge thereof, a third upright wall parallel to the first wall and connected to said second wall at an edge thereof so as to define a pulley channel rearwardly of the valance for receiving a cord pulley device for raising and lowering the blind, said third wall extending to a position substantially the same height as an upper edge of the valance, a fourth horizontal wall interconnected with said third wall at an intermediate height thereof, a fifth wall extending downwardly from said fourth wall to a position of the same height as the bottom of the third wall, a pair of flanges extended inwardly toward one another from the bottom edge of the fifth wall and the bottom edge of the third wall so as to define therebetween a slot of reduced dimension relative to the spacing between the third and fifth walls for receiving and clamping the edge of the blind and a sixth wall connected to the top edge of the third wall and extending generally in a direction away from the valance and downwardly for cooperation with an upwardly and forwardly directed hook member whereby the headrail can be attached to a suitable surface for supporting the blind depending downwardly therefrom rearwardly of the valance and the pulley channel.

2. The headrail according to claim 1 including a cord and a cord pulley device mounted in the pulley channel at an opening at the bottom web thereof and means defining a hole in the bottom web adjacent pulley device through which the cord can pass.

3. The headrail according to claim 1 wherein the sixth wall is directed downwardly at an angle of the order of 40 degrees.

4. The headrail for a window blind comprising a integral extruded section defining a first upright wall providing a front valance, a second horizontal wall connected to said wall adjacent a lower edge thereof, a third upright wall parallel to the first wall and connected to said second wall at an edge thereof so as to define a pulley channel rearwardly of the valance for receiving a cord pulley device for raising and lowering the blind, said third wall extending to a position substantially the same height as an upper edge of the valance, a fourth horizontal wall interconnected with said third wall at an intermediate height thereof, a fifth wall extending downwardly from said fourth wall substantially parallel to the third wall, cooperating means extending inwardly of the fifth wall and the third wall so as to define therebetween a slot of reduced dimension relative to the spacing between the third and fifth walls for receiving and clamping the edge of the blind and a sixth wall connected to the top edge of the third wall and including means for cooperating with a hook member whereby the headrail can be attached to a suitable surface for supporting the blind depending downwardly therefrom rearwardly of the valance and the pulley channel.

* * * * *